United States Patent [19]

Graulty

[11] Patent Number: 4,939,320

[45] Date of Patent: Jul. 3, 1990

[54] SELF-SETTING SWITCH-ACTUATING ASSEMBLY AND METHOD

[76] Inventor: Mark T. Graulty, 1019 Gatewood Dr., Bethel Park, Pa. 15102

[21] Appl. No.: 162,774

[22] Filed: Mar. 1, 1988

[51] Int. Cl.[5] ..... H01H 3/00

[52] U.S. Cl. ..... 200/17 R; 200/18; 200/31 R; 200/47; 200/302.1; 335/206

[58] Field of Search ..... 200/17 R, 18, 30 R, 200/31 R, 38 BA, 38 CA, 47, 61.39, 61.86, 153 L, 153 N, 153 T, 302.1; 335/206

[56] References Cited

U.S. PATENT DOCUMENTS

| | | | |
|---|---|---|---|
| 2,951,920 | 9/1960 | Miller | 200/47 |
| 3,306,997 | 2/1967 | Jacobs | 200/153 T |
| 3,418,610 | 12/1968 | Hammond | 335/206 |
| 3,426,303 | 2/1969 | Buckner | 335/206 |
| 3,429,335 | 2/1969 | Grassel et al. | 137/487.5 |
| 3,484,075 | 12/1969 | Weekley | 251/134 |
| 3,680,831 | 8/1972 | Fujiwara | 251/134 |
| 3,870,274 | 3/1975 | Broe | 251/134 |
| 3,980,846 | 9/1976 | Yoshida | 200/61.39 |
| 4,247,744 | 1/1981 | Birkle | 200/153 T X |
| 4,406,934 | 9/1983 | Elszasz | 200/61.39 |
| 4,407,326 | 10/1983 | Wilhelm | 137/553 |
| 4,556,194 | 12/1985 | van Lingen | 251/129.12 |
| 4,621,789 | 11/1986 | Fukamachi | 251/129.12 |
| 4,647,007 | 3/1987 | Bajka | 251/129.03 |

*Primary Examiner*—J. R. Scott

*Attorney, Agent, or Firm*—Michael R. Swartz; John R. Flanagan

[57] ABSTRACT

A self-setting switch-actuating assembly includes a pair of cam members and a rotational motion transmitting shaft. The cam members are mounted on the shaft. The shaft is rotatably mounted between a pair of switches and is connected to a rotatable device whose rotational movement will cause rotation of the shaft and will stop in response to reaching angularly-displaced limits. The cam members are mounted on the shaft one above the other with each cam member aligned with only one of the switches and movable along a rotational path toward and away from a predetermined actuating position relative to its aligned one of the switches in response to rotation of the shaft. Also, each cam member is mounted on the shaft so as to be capable of stopping movement in response to reaching its predetermined actuating position and relative to continuing rotation of the shaft thereby permitting a predetermined degree of overtravel of the shaft relative to each of the cam members at their respective actuating positions.

25 Claims, 3 Drawing Sheets

SELF-SETTING SWITCH-ACTUATING ASSEMBLY AND METHOD

BACKGROUND OF THE INVENTION

1. Field of the Invention

The present invention relates generally to position sensing and indicating devices and, more particularly, is concerned with a self-setting switch-actuating assembly and a method of self-setting a pair of actuating cams of the actuating assembly relative to a pair of switches.

2. Description of the Prior Art

It is conventional practice to use actuation of micro or limit switches to control positioning of a rotatable valve at a selected one of its opened and closed conditions. Typically, a pair of angularly displaced cams are integrally formed or rigidly attached, on a shaft coupled for rotation with a rotatable stem of the valve. As the shaft rotates in either a clockwise or counterclockwise direction with the valve stem, the actuating cams will move either clockwise or counterclockwise along a path which brings one or the other of the cams into contact with one or the other of the limit switches, causing the stem of the valve to stop and thereby place the valve at either its opened or closed condition. Representative of such cam arrangements in the prior patent art for actuating limit switches to control valve position are the ones disclosed in U.S. Pat. Nos. to Grassel et al (3,429,335), Weekley (3,484,075), Fujiwara (3,680,831), Broe (3,870,274), Wilhelm (4,407,326), van Lingen (4,556,194), Fukamachi (4,621,789) and Bajka (4,647,007).

These same arrangements are also used to actuate limit switches for sensing when rotational components such as a valve stem has reached either its opened or closed condition so that indicator lights can be turned on and off or status signals transmitted to a computer. However, most of these arrangements require performance of complicated procedures for initial setup of the angular orientation of the cams and their mounting shaft relative to the rotational position of the valve stem to ensure proper actuation of the limit switches. Also, periodically, the setup must be examined and, if needed, adjustments made. The initial setup of the arrangement and its periodic examination requires careful and accurate initial assembling and subsequent reassembling of parts which is time-consuming and subject to human error.

Consequently, a need exists for a more reliable and substantially error-free way of ensuring accurate actuation of the limit switches for controlling valve stem position.

SUMMARY OF THE INVENTION

The present invention provides a self-setting switch-actuating assembly and a method of self-setting the switch-actuating assembly designed to satisfy the aforementioned needs. The hallmark of the present invention is the simplicity of the arrangement of parts devised to enable the actuating assembly to be self-setting after, rather than before, assembling of its parts. Achievement of self-setting after assembling of the parts of the actuating assembly reduces the level of human skill required for properly assembling the parts and thereby the possibility of human error causing unreliable operation of the switch-actuating assembly.

Accordingly, the present invention is directed to a self-setting assembly for actuating a pair of spaced apart switches. The self-setting assembly comprises: (a) a pair of cam members adapted to actuate the switches when placed in respective predetermined actuating positions relative thereto; (b) a rotational motion transmitting member adapted to be rotatably mounted adjacent to the switches and connectible to a rotatable device whose rotational movement will cause rotation of the motion transmitting member; and (c) means for mounting the cam members on the motion transmitting member one above the other with each cam member aligned with only one of the switches. The mounting means adapts each of the cam members to be movable along a rotational path toward and away from one of the actuating positions relative to its aligned one of the switches in response to rotation of the motion transmitting member. The mounting means also adapts each of the cam members to be capable of stopping movement in response to reaching its one of the actuating positions and relative to continuing rotation of the motion transmitting member thereby permitting a predetermined degree of overtravel of the motion transmitting member relative to each of the cam members at their respective actuating positions.

More particularly, the mounting means is configured for imposing an amount of frictional force upon each cam member being sufficient to cause the cam member to move along its rotational path with rotation of the motion transmitting member so long as the rotational path of the cam member remains unobstructed. The amount of frictional force imposed on each cam element is also insufficient to prevent relative rotation between each cam element and the motion transmitting member for permitting stopping of movement of each cam member relative to continuing rotation of the motion transmitting member upon engagement of the cam member with an obstruction in its rotational path at the actuating position of each cam member.

In one embodiment, the mounting means includes a central opening defined through each of cam members and a cylindrical surface defined on the motion transmitting member adapted to be inserted through each of the cam member openings for mounting each of the cam members on the mounting member. Each opening is of a diametric size less than that of the cylindrical surface of the motion transmitting means for imposing the required amount of frictional force on the cam member. In this embodiment, the cam members are preferably composed of a plastic material.

In another embodiment, the mounting means includes a central opening defined through each of the cam members, a cylindrical surface defined on the motion transmitting member adapted to be inserted through each of the cam member openings for mounting each of the cam members on the mounting member, and a plurality of yieldable spring elements, such as Belleville type springs, mounted on the motion transmitting member and engaged with the cam members so as to impose the required amount of frictional force thereon. In this embodiment, the cam members are preferably made of metal material.

Also, the present invention is directed to a method of self-setting an assembly for actuating switches. The self-setting method comprises the steps of: (a) coupling a rotational motion transmitting shaft being located between the switches to a rotatable device whose rotational movement will cause rotation of the shaft and will stop in response to reaching one or the other of a pair of angularly-displaced limits; (b) imposing upon each of a pair of cam members mounted one above the other on the motion transmitting shaft an amount of frictional force being sufficient to cause the cam member to move along a rotational path with rotation of the shaft so long as the rotational path remains unobstructed and also insufficient to prevent relative rotation between the cam member and the shaft for allowing stopping of movement of the cam member relative to continuing rotation of the shaft upon engagement of the cam member with an obstruction in the rotational path at an actuating position of each cam member adjacent one of the switches; (c) manually rotating each of the cam members relative to the shaft to its respective actuating position; (d) rotating the rotatable device until it reaches one of its angularly-displaced limits to cause rotation of the motion transmitting shaft and thereby one of the cam elements away from its actuating position and toward the other cam element as the other cam element remains at its actuating position; and (e) rotating the rotatable device until it reaches the other of its angularly-displaced limits to cause rotation of the motion transmitting shaft and thereby the other of the cam elements away from its actuating position and toward and into alignment with the one cam element as the one cam element remains at its actuating position.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
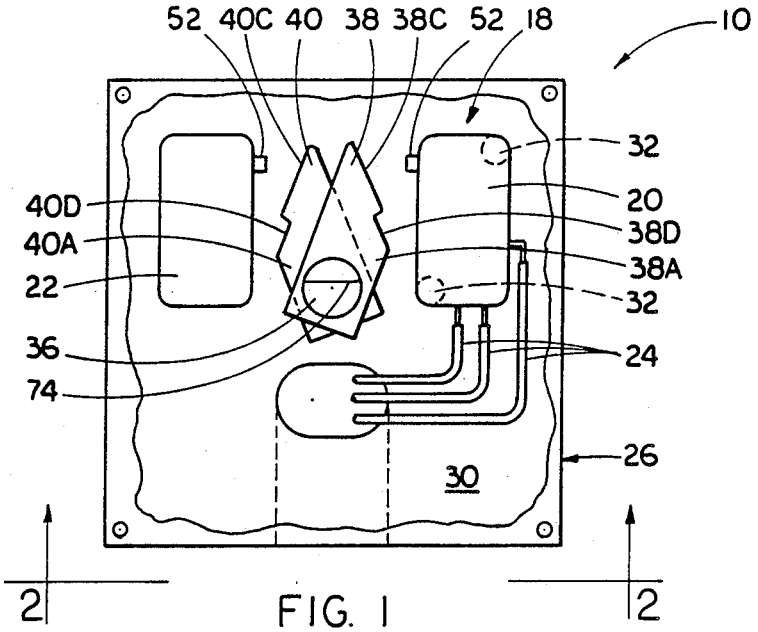
FIG. 1 is a top plan view of a position sensing apparatus incorporating a self-setting switch-actuating assembly being constructed in accordance with the principles of the present invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring now to the drawings, and particularly to FIGS. 1–6, there is shown a position sensing apparatus 10 adapted for use with many different devices designed for rotation between angularly-displaced limits, one such device being a drive shaft 12 of an actuator 14 being rotatable for rotatably moving a stem of a valve 16 between opened and closed positions. The position sensing apparatus 10 incorporates a self-setting switch-actuating assembly, generally designated by the numeral 18 and being constructed in accordance with the principles of the present invention. The switch-actuating assembly 18 is adapted to actuate one or the other of a pair of micro or limit switches 20, 22 of the position sensing apparatus 10 upon rotation of the actuator drive shaft 12 and thus the valve stem to one or the other of their limit positions placing the valve 16 in either its opened or closed position. The actuation of one or the other of the limit switches 20, 22 thereby senses whether the valve 16 is opened or closed and can be electrically connected via wires 24 (only the ones connected to the limit switch 20 being shown) to energize an indicator light (not shown) or to transmit a signal to a computer (not shown) providing information about the status of the valve 16.

More particularly, the position sensing apparatus 10 includes a mounting base 26 having a mounting bracket 28 for attaching it above the actuator 14. The limit switches 20, 22 are mounted in spaced apart relation on the mounting base 26. Also, the left switch 22 is disposed upon the upper surface 30 of the mounting base 26, whereas the right switch 20 is spaced thereabove by a pair of diagonally spaced mounting collars 32 so as to define open space 34 below the right switch 20, extending between it and the upper surface 30 of the mounting base 26.

The self-setting switch-actuating assembly 18 incorporated by the position sensing apparatus 10 basically inciudes a cylindrical-shaped rotational motion transmitting shaft 36 and a pair of self-setting switch-actuating cam members 38, 40. The motion transmitting shaft 36 is rotatably mounted in an upright orientation on a mounting base 26 between the switches 20, 22 thereon, with an upper portion 42 of the shaft 36 extending above the upper surface 30 of the base 26 and a lower portion 44 of the shaft 36 extending below a lower surface 46 of the base 26. A bayonet-type coupler 48 is attached on the end of lower shaft portion 44 for drivingly connecting the motion transmitting shaft 36 to the actuator drive shaft 12 such that rotation of the drive shaft 12 will concurrently cause rotation of the motion transmitting shaft 36.

Figure 6:
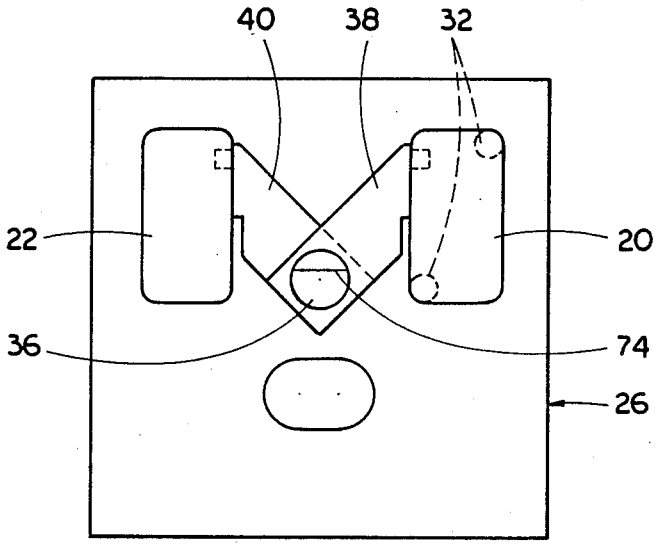
FIGS. 6–8 are top plan views similar to that of FIG. 1, but showing the sequence of steps for self-setting the cam members of the switch-actuating assembly of the present invention.

The rotation transmitted from the drive shaft 12 to the motion transmitting shaft 36 by the coupler 48 is in a one-to-one ratio. Typically, rotation of the drive shaft 12 between its limit positions will be through approximately 90 degrees as seen in the arrangement of FIGS. 1 and 6; however, the switches 20, 22, shaft 36 and cam members 38, 40 can be arranged to accommodate at least up to 270 degrees of rotation. Alternatively, a gear reduction mechanism can be employed to couple the two shafts 12, 36 together such that rotation of the shaft 12 through a displacement between its opposite limit positions ranging from greater than 270 degrees to multiples of 360 degrees can be reduced to only 270 or less degrees of rotation of the shaft 36.

Figure 5:
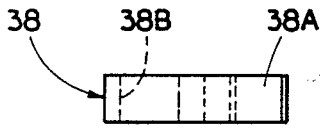
FIG. 5 is a side elevational view of the other cam member as seen along line 5—5 of FIG. 4.
Figure 3:
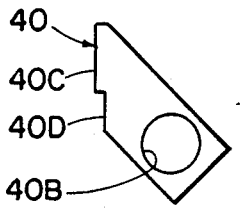
FIG. 3 is a top plan view of one cam member of the self-setting switch-actuating assembly of FIG. 1 shown removed from the assembly.
Figure 4:
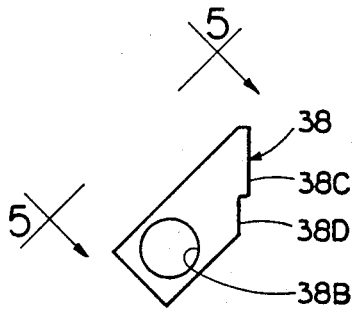
FIG. 4 is a top plan view of the other cam member of the self-setting switch-actuating assembly of FIG. 1 shown removed from the assembly.

The self-setting cam members 38, 40 of the switch-actuating assembly 18 are adapted to actuate the respective switches 20, 22 when placed in the respective actuating positions shown in FIG. 6. As seen in FIGS. 3–5, the cam member 38, 40 have identical constructions; however, in use, one is simply flipped over relative to the other. Each cam member 38, 40 is composed of an elongated body 38A, 40A having an opening 38B, 40B defined therethrough at one end portion having a rectangular configuration for mounting the cam member over a cylindrical surface 50 on the upper portion 42 of the motion transmitting shaft 36. The opposite end portion of the cam member 38, 40 has tapered configuration with a switch-actuating surface 38C, 40C defined on the body 38A, 40A in an offset relation to the motion transmitting shaft 36. Finally, an undercut or cutout region 38D, 40D is formed in the body 38A, 40A adjacent the switch-actuating surface 38C, 40C to reduce the amount of surface area of the body potentially capable of inadvertent engagement with the switch 20, 22 due to dimensional irregularity of either the cam member or the switch which might interfere with proper actuation of the switch.

Figure 10:
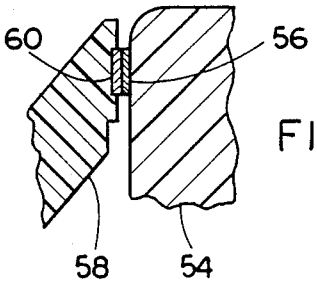
FIG. 10 is an enlarged fragmentary sectional view of the tip of one of the cam members and of the tip of one of the switches, showing a different version thereof.

As shown in FIGS. 1, 2 and 6–8, the switches 20, 22 have reciprocal buttons 52 adapting them to be actuated mechanically by the cam members 38, 40 through physical or mechanical contact therewith when the surfaces 38C, 40C of the cam members are placed at the respective actuating positions. Alternatively, magnetic switches 54, such as shown in fragmentary form in FIG. 10, can be employed. In the latter embodiment, magnetic elements 56 attached on the cam members 58 will magnetically actuate magnet elements 60 on the magnetic switches 54 when the cam members are placed at the respective actuating positions.

Returning again to FIGS. 1, 2 and 6–8, it can be seen that the cam members 38, 40 are mounted on the motion transmitting shaft 36 with the one cam member 38 above the other cam member 40. An annular shoulder 62 can be defined on the shaft 36 to separate the cam members 38, 40 or, alternatively, it can be omitted. In such positional relationship, the upper cam member 38 is aligned with only the right raised switch 20 and open space 64 above the left lower switch 22 whereas the lower cam member 40 is aligned with only the left lower switch 22 and open space 34 below the right raised switch 38.

Figure 8:
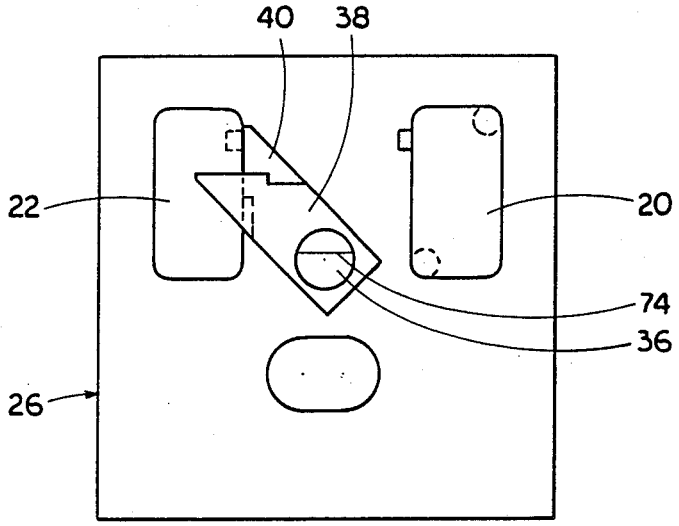
Figure 7:
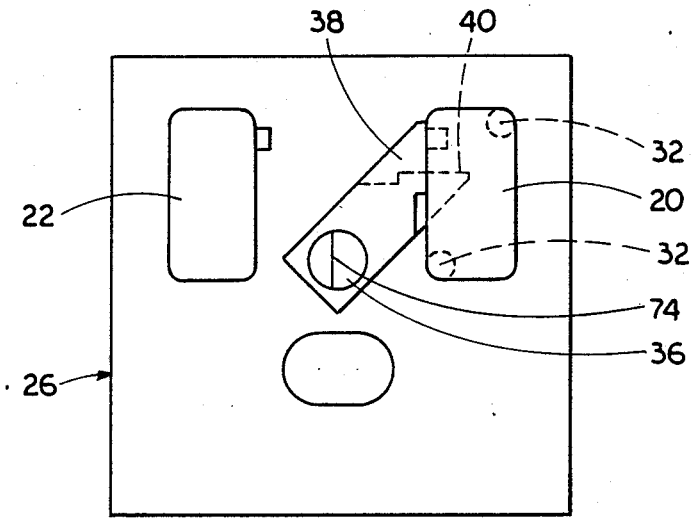

As seen in FIGS. 7 and 8, with rotational movement of the shaft 36, each of the cam members is adapted to move therewith along a rotational path toward and away from its respective actuating position relative to its aligned one of the switches 20, 22 and into and from its aligned one of the open spaces 64, 34 above and below the respective one of the switches not aligned therewith. Further, as will be explained below, each of the cam members 38, 40 is adapted to stop its movement in response to reaching its actuating position where the cam member makes contact with the respective switch 20, 22 with the switch thus acting as a stop. It should be understood that structures separate from the switches could be provided to serve as stops for the cam members.

The mounting relation of the cam members 38, 40 to the shaft 36 is such as to allow relative rotation between them when the cam members contact the switches. Thus, rotation of the shaft 36 can continue thereby permitting a predetermined degree of overtravel of the shaft 36 relative to each of the cam members 38, 40 at their respective actuating positions. For example, approximately two degrees of overtravel is built in. Thus, although the angularly-displaced limits of the opened and closed positions of the stem of the valve 16 and thus of the actuator shaft 12 are about ninety degrees apart, the actuating positions of the switches 20, 22 are only eighty-eight degrees apart.

Two different configurations are disclosed and illustrated herein for permitting relative rotation between the cam members 38, 40 and the shaft 36 once the switches 20, 33 are contacted but for making the cam members move with the shaft 36 when no obstructions are encountered in the rotational paths of the cam members. In each configuration, the same concept is involved, that being to in some manner impose an amount of frictional force upon each cam member 38, 40 that is sufficient to cause the cam member to move along its rotational path with rotation of the shaft 36 so long as the rotational path of the cam member remains unobstructed. However, the amount of frictional force must be insufficient to prevent relative rotation to take place between each cam element 38, 40 and the shaft 36 so that stopping of cam member movement is permitted relative to continuing rotation of the shaft upon engagement of the cam member with an obstruction in its rotational path, such as the switch, at the actuating position of each cam member.

In the preferred embodiment of FIGS. 1–8, the cam members 38, 40 of the self-setting assembly 18 are made of plastic material while the shaft 36 is made of metal material. This allows the openings 38B, 40B defined through the bodies 38A, 40A of the cam members 38, 40 to be of diametric sizes less than that of the cylindrical surface 50 defined on the shaft 12 over which the cam members are inserted. Such relationship between the respective diameter sizes allows imposition of the required amount of frictional force on the cam member 38, 40 by the shaft 12 where the cam members are constructed of plastic material which is capable of plastic deformation to accommodate the size disparities.

Figure 9:
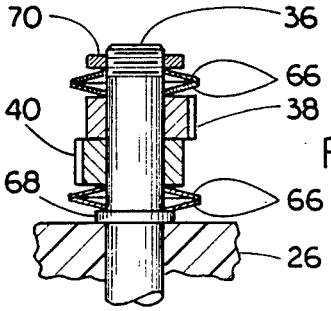
FIG. 9 is a longitudinal axial sectional view of a modified embodiment of the switch-actuating assembly.

However, in high temperature environments, plastic material is unsuitable for use and thus both the shaft 36 and cam members 38, 40 must be constructed of metal material in order to withstand the temperatures. In such situations, provision of different diameter sizes to create the required frictional forces cannot be employed. Instead, as illustrated in FIG. 9, pairs of resiliently yieldable annular spring elements 66, such as Belleville type washers or springs, are fitted over the shaft 36 above and below the cam members 38, 40. In this configuration, the diameters of the openings 38B, 40B in the cam members 38, 40 must be somewhat greater than the diameter of the cylindrical surface 50 on the shaft 36 in order to fit the cam members over the shaft. The lower set of springs 66 rest on an annular shoulder 68 formed about the shaft 12. A nut 70 is threaded onto the upper end of the shaft 12 so as to compress the spring elements 66 against the cam elements 38, 40 and thereby imposed the required amount of frictional force thereon.

Figure 2:
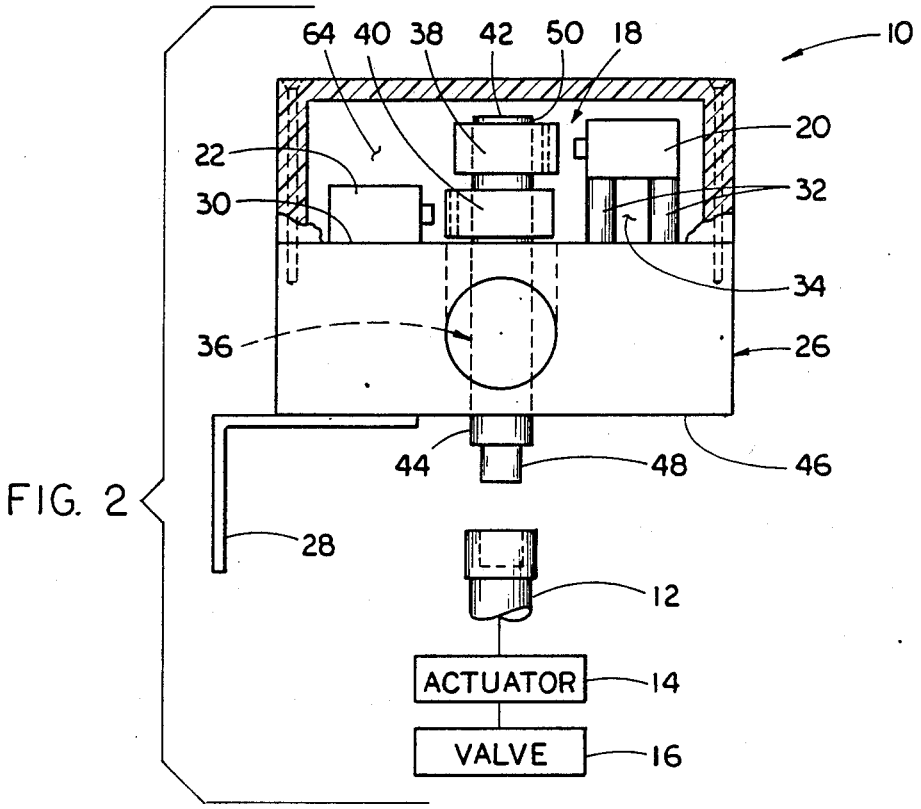
FIG. 2 is a side elevational view of the position sensing apparatus and self-setting actuating assembly as seen along line 2—2 of FIG. 1, also illustrating a cover in section and a mounting bracket attached to a mounting base of the apparatus.

Once the cam members 38, 40 have been installed on the shaft 36 as seen in FIGS. 1 and 2 and then both manually rotated relative to the shaft to the initial position shown in FIG. 6 wherein their actuating surfaces 38C, 40C abut the actuating buttons 52 of the respective switches 20, 22, the cam members are positioned for subsequent self-setting of the actuating assembly 18.

Before, the remaining steps are carried out for performing the self setting, a cover 72 can be attached on the mounting base 26 of the apparatus 10 for enclosing and sealing the switches 20, 22, the shaft 36 and the cam members 38, 40 from the external environment.

FIGS. 7 and 8 illustrated the final steps in self-setting the switch-actuating assembly 18. FIG. 7 shows the cam members after the actuator shaft 12 has been pulsed to rotate to its one limit position which causes the shaft 36 to rotate clockwise from its initial position of FIG. 6 as indicated by the horizontal orientation of a line 74 drawn thereon to the angularly-displaced position of FIG. 7 as indicated by the vertical orientation of the line 74 thereon. Whereas an approximately 90 degree clockwise movement is illustrated, it should be understood that the degrees of movement of the shaft 36 can be less than that if the actuator shaft 12 moved from some intermediate position between its extreme limit positions. If the shaft 36 moves less than ninety degrees, then the lower cam member 40 would not reach its position of FIG. 7 wherein it is disposed in the open space 34 below the right switch 20.

However, when the actuator shaft 12 has been pulsed to move to its opposite other limit position causing the shaft 36 to rotate to the angular position shown in FIG. 8, now the shafts 12 and 36 move the full ninety degrees and the upper cam member 38 rotates from its actuating position of FIG. 7 to the position of FIG. 8 where it is disposed in the open space 64 above the lower switch 22. The lower cam member 40 rotates counterclockwise until it abuts and stops against the lower switch 22 at its actuating position adjacent the lower switch 22. The upper cam member 38 is also now aligned above the lower cam member. The assembly 18 is now self-set for operation in sensing the positioning of the actuator shaft 12 and the valve stem at either of the opposite limit positions of the valve 16.

It is thought that the self-setting switch-actuating assembly of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A self-setting switch-actuating assembly, comprising:

(a) a mounting base for mounting a pair of switches in spaced apart relation at predetermined locations on said mounting base;

(b) a pair of cam members for actuating the switches when the switches are mounted at said predetermined locations on said mounting base and said cam members are placed in predetermined actuating positions relative thereto;

(c) a rotational motion transmitting member rotatably mounted on said mounting base adjacent to the switches when the latter are mounted at said predetermined locations on said mounting base, said motion transmitting member being connectible to a rotatable device whose rotational movement will cause rotation of said motion transmitting member; and (d) mounting said cam members on said motion transmitting member one above the other with each cam member aligned with only one of said switches when the latter are mounted at said predetermined locations on said mounting base, said mounting means for permitting self-setting of each of said cam members relative to said motion transmitting member by allowing movement of said cam member along a rotational path toward and away from one of said actuating positions relative to its aligned one of the switches in response to corresponding rotation of said motion transmitting member and stopping of movement of said cam member in response to reaching its actuating position and relative to continuing rotation of said motion transmitting member thereby permitting a predetermined degree of overtravel of said motion transmitting member relative to each of said cam members at their respective actuating positions for accomplishing said self-setting of said cam members.

2. The assembly as recited in claim 1, wherein said mounting means is configured for imposing an amount of frictional force upon said each cam member being sufficient to cause said cam member to move along its rotational path with rotation of said motion transmitting member prior to reaching its actuating position, said amount of frictional force imposed on each cam member also being insufficient to prevent relative motion between each cam member and said motion transmitting member for permitting stopping of movement of each cam member relative to continuing rotation of said motion transmitting member upon said cam member reaching its actuating position.

3. The assembly as recited in claim 2, wherein said mounting means includes a central opening defined through each of said cam members and a cylindrical surface defined on said motion transmitting member for insertion through each of said cam member openings for mounting each of said cam members on said motion transmitting member, said each opening being of a diametric size less than that of said cylindrical surface of said motion transmitting member for imposing the required amount of frictional force on the cam member.

4. The assembly as recited in claim 3, wherein said cam members are composed of a plastic material.

5. The assembly as recited in claim 2, wherein said mounting means includes a central opening defined through each of said cam members, a cylindrical surface defined on said motion transmitting member for insertion through each of said cam member openings for mounting each of said cam members on said motion transmitting member, and a plurality of yieldable spring elements mounted on said motion transmitting member and engaged with said cam members so as to impose the required amount of frictional force thereon.

6. The assembly as recited in claim 5, wherein said cam members are made of metal material.

7. The assembly as recited in claim 5, wherein said spring elements are in the form of Belleville type.

8. The assembly as recited in claim 1, wherein each of said cam members is composed of an elongated body having an opening defined therethrough for mounting said body to said motion transmitting member and a switch-actuating surface defined on said body in offset relation to said motion transmitting member.

9. The assembly as recited in claim 1, wherein each of said cam members is composed of an elongated body having a switch-actuating surface defined thereon and an undercut formed in said body adjacent said surface to reduce the amount of surface area of said body potentially capable of inadvertent engagement with said switch due to dimensional irregularity of either said cam member or said switch.

10. The assembly as recited in claim 1, wherein said cam members are capable of mechanically actuating said respective switches when disposed at said respective actuating positions.

11. The assembly as recited in claim 1, wherein said cam members are capable of magnetically actuating said respective switches when disposed at said respective actuating positions.

12. In a position sensing apparatus, the combination comprising:

(a) a mounting base;

(b) a pair of switches mounted in spaced apart relation on said mounting base and in offset relation such that one switch is disposed closer to said mounting base than the other switch so as to define open space above said one switch and below said other switch;

(c) a pair of self-setting switch-actuating cam members for actuating said switches when placed in predetermined actuating positions relative thereto;

(d) a rotational motion transmitting shaft rotatably mounted on said mounting base generally between said switches thereon and being connectible to a rotatable device whose rotational movement will cause rotation of said motion transmitting shaft and will stop in response to reaching angularly-displaced limits of such rotational movement; and (e) means mounting said cam members on said motion transmitting shaft with one cam member above the other cam member such that said one cam member is aligned with only said other switch and open space above said one switch whereas said other cam member is aligned with only said one switch and open space below said other switch, said mounting means for permitting self-setting of each of said cam members relative to said motion transmitting shaft by allowing movement of said cam member along a rotational path toward and away from one of said actuating positions relative to its aligned switch and into and from the open spaces above and below its nonaligned switch in response to corresponding rotation of said motion transmitting shaft and stopping of movement of said cam member in response to reaching its actuating position and relative to continuing rotation of said motion transmitting shaft thereby permitting a predetermined degree of overtravel of said motion transmitting shaft relative to each of said cam members at their respective actuating positions for accomplishing said self-setting of said cam members.

13. The assembly as recited in claim 12, wherein said mounting means is configured for imposing an amount of frictional force upon said each cam member being sufficient to cause said cam member to move along its rotational path with rotation of said motion transmitting shaft prior to reaching its actuating position, said amount of frictional force imposed on each cam member also being insufficient to prevent relative rotation between each cam member and said motion transmitting shaft for permitting stopping of movement of said cam member relative to continuing rotation of said motion transmitting shaft upon said cam member reaching its actuating position.

14. The assembly as recited in claim 13, wherein said mounting means includes a central opening defined through each of said cam members and a cylindrical surface defined on said motion transmitting shaft for insertion through each of said cam member openings for mounting each of said cam members on said motion transmitting shaft, said each opening being of a diametric size less than that of said cylindrical surface of said motion transmitting shaft for imposing the required amount of frictional force on the cam member.

15. The assembly as recited in claim 14, wherein said cam members are composed of a plastic material.

16. The assembly as recited in claim 13, wherein said mounting means includes a central opening defined through each of said cam members, a cylindrical surface defined on said motion transmitting shaft for insertion through each of said cam member openings for mounting each of said cam members on said motion transmitting shaft, and a plurality of yieldable spring elements mounted on said motion transmitting shaft and engaged with said cam members so as to impose the required amount of frictional force thereon.

17. The assembly as recited in claim 16, wherein said cam members are made of metal material.

18. The assembly as recited in claim 16, wherein said spring elements are in the form of Belleville type.

19. The assembly as recited in claim 12, wherein each of said cam members is composed of an elongated body having an opening defined therethrough for mounting said body to said motion transmitting shaft and a switch-actuating surface defined on said body in offset relation to said motion transmitting shaft.

20. The assembly as recited in claim 12, wherein each of said cam members is composed of an elongated body having a switch-actuating surface defined thereon and an undercut formed in said body adjacent said surface to reduce the amount of surface area of said body potentially capable of inadvertent engagement with said switch due to dimensional irregularity of either said cam member or said switch.

21. The assembly as recited in claim 12, wherein:

said switches are capable of being actuated mechanically; and said cam members are capable of mechanically actuating said respective switches when disposed at said respective actuating positions.

22. The assembly as recited in claim 12, wherein:

said switches are capable of being actuated magnetically; and said cam members are capable of magnetically actuating said respective switches when disposed at said respective actuating positions.

23. The assembly as recited in claim 12, further comprising:

(f) a cover attachable on said mounting base for enclosing and sealing said switches, motion transmitting shaft and cam members from the external environment.

24. A method of self-setting an assembly for actuating a pair of switches spaced apart on a mounting base, said method comprising the steps of:

(a) coupling a rotational motion transmitting shaft being rotatably mounted on the mounting base between the switches to a rotatably device whose rotational movement will cause rotation of the shaft and will stop in response to reaching one or the other of a pair of angularly-displaced limits;

(b) imposing upon each of a pair of cam members mounted one above the other on the motion transmitting shaft an amount of frictional force being sufficient to cause the cam member to move along a rotational path with rotation of the shaft toward and away from an actuating position adjacent one of the switches and also insufficient to prevent relative rotation between the cam member and the shaft for permitting stopping of movement of the cam member relative to continuing rotation of the shaft upon the cam member reaching its actuating position adjacent one of the switches;

(c) as the shaft is maintained stationary, manually rotating each of the cam members about the shaft to its respective actuating position;

(d) rotating the rotatable device until it reaches one of its angularly-displaced limits to cause rotation of the motion transmitting shaft and thereby one of the cam elements away from its actuating position and toward the other cam element as the other cam element remains at its actuating position; and (e) rotating the rotatable device until it reaches the other of its angularly-displaced limits to cause rotation of the motion transmitting shaft and thereby the other of the cam elements away from its actuating position and toward and into alignment with the one cam element as the one cam element remains at its actuating position, such that each of the cam elements are now self-set for actuating its respective one of the switches at said respective actuating positions for sensing the positioning of the rotatable device at either of the opposite limit positions thereof upon rotation of the rotatable device therebetween.

25. The method as recited in claim 24, further comprising the step of:

(f) attaching a cover to the mounting base to enclose and seal the switches, motion transmitting shaft and cam members from the external environment, said attaching of the cover being completed before steps (d) and (e) are carried out.

* * * * *